US005902510A

United States Patent [19]

Balbaa et al.

[11] Patent Number: 5,902,510

[45] Date of Patent: May 11, 1999

[54] ROTARY MICROWAVE OVEN FOR CONTINUOUS HEATING OF MATERIALS

[75] Inventors: Ibrahim Sabri Balbaa; Joseph Terrance Strack, both of Mississauga; Nobuyoshi Miura, Etobicoke; Richard Solczyk, Toronto, all of Canada

[73] Assignee: Ontario Hydro, Toronto, Canada

[21] Appl. No.: 08/874,356

[22] Filed: Jun. 13, 1997

[30] Foreign Application Priority Data

Jun. 14, 1996 [CA] Canada ..... 2179125

[51] Int. Cl.[6] ..... H05B 6/78

[52] U.S. Cl. ..... 219/698; 219/699; 219/700; 219/752; 219/762

[58] Field of Search ..... 219/698, 699, 219/700, 701, 742, 741, 762, 752, 753; 34/259, 261, 264

[56] References Cited

U.S. PATENT DOCUMENTS

| | | | |
|---|---|---|---|
| 3,261,959 | 7/1966 | Connell et al. | 219/700 |
| 3,549,848 | 12/1970 | Williams | 219/698 |
| 4,129,768 | 12/1978 | Anderson | 219/701 |
| 4,180,718 | 12/1979 | Hanson | 219/700 |
| 4,211,910 | 7/1980 | Kusunoki et al. | 219/742 |
| 4,326,114 | 4/1982 | Gerling et al. | 219/700 |
| 4,459,450 | 7/1984 | Tyler et al. | 219/701 |
| 4,471,194 | 9/1984 | Hosokawa et al. | 219/742 |
| 4,780,586 | 10/1988 | Le Viet et al. | 219/700 |

*Primary Examiner*—Philip H. Leung
*Attorney, Agent, or Firm*—Pennie & Edmonds LLP

[57] ABSTRACT

A microwave furnace for heating materials has a microwave chamber with two microwave compartments made of microwave reflective material for retaining microwaves. One of the compartments is fixed and has an opening for discharging heated material. The other compartment is a rotating drum. The furnace also includes an elongated tubular member having a first and second open end. The tubular member is made of a microwave transparent material and is retained within the microwave chamber. A feeding mechanism feeds the material to be heated into the first end of the tubular member. The microwave furnace is provided with a mount for supporting the tubular member within the rotating microwave chamber by clasping the tubular member. The mount is adapted to rotate the tubular member along its axis and to position the tubular member such that the second end of the tubular member is substantially adjacent to the discharge opening of the fixed microwave chamber. Finally, the microwave furnace is provided with a microwave generator for generating microwaves and guiding them into the microwave chamber.

19 Claims, 2 Drawing Sheets

ROTARY MICROWAVE OVEN FOR CONTINUOUS HEATING OF MATERIALS

FIELD OF THE INVENTION

The invention relates to microwave ovens for heating microwave absorbent materials.

BACKGROUND OF THE INVENTION

Microwave ovens and furnaces have been known for some time. In many house hold microwave ovens, the microwaves are generated in an enclosed heating compartment made of a microwave reflective material such as steel or aluminum. The microwaves are retained in the compartment and are eventually absorbed by the microwave absorptive materials placed within the compartment. In commercial scale units, the microwave energy is generated by a separate microwave generator and then channeled into the separate heating compartment via a microwave waveguide. The waveguide generally comprises a conduit made of a microwave reflective material. Uniform heating of the material is assisted by the inclusion of devices for rotating or agitating the material.

To permit the continuous heating of granular material, microwave ovens have been made having a long microwave transparent conduit, part of which is contained within the microwave reflective heating compartment. The material to be heated is then passed through the conduit, and as it passes through the portion of the conduit contained in the heating compartment, the material is exposed to microwaves. This arrangement permits the uninterrupted flow of material through the microwave reflective heating chamber. However, since the microwave transparent conduit must enter and exit the microwave reflective heating chamber, there is always the possibility that microwave energy will escape the heating chamber by exiting at the point where the conduit meets the walls of the heating chamber. To minimize this leakage, the diameter of the microwave transparent conduit must be minimized. This design limitation restricts the maximum flow-through rates of this type of microwave oven. Furthermore, since the consequences of leaked microwaves are graver where high intensity microwaves are required, this basic design effectively limits the maximum microwave intensities that can be safely used, and therefore, the maximum heating temperatures possible. Finally, the limitations placed on this design of microwave ovens greatly limits the versatility of the oven. Usually, each oven is designed with a particular sized conduit in mind to accommodate a particular flow rate and heating temperature for any given material. There is a need for a versatile and safe continuous flow microwave oven that can operate at high temperatures and high flow rates.

SUMMARY OF THE INVENTION

The present invention is a microwave oven for heating materials having a microwave chamber made of microwave reflective material, the chamber having an opening for discharging the heated material. An elongated tubular member is mounted within the chamber and has a first and second open end. The tubular member is made of a microwave transparent material. The microwave oven is also provided with a feeding mechanism for feeding the material to be heated into the first end of the tubular member. The tubular member is mounted within the microwave chamber via a mounting means that mounts the tubular member and positions it such that the second end of the tubular member is substantially adjacent the discharge opening of the microwave chamber. The mounting means is also adapted to rotate the tubular member along its axis. Finally, the oven is provided with a microwave generator for transmitting microwaves into the microwave chamber.

The present invention is also directed at a microwave oven wherein the microwave chamber comprises a first compartment and a second compartment, the first compartment having the discharge opening and dimensioned to retain the portion of the tubular member adjacent the second end thereof, the second compartment dimensioned to retain the portion of the tubular member adjacent the first end thereof. In the preferred embodiment of the present invention, the microwave generator guides the microwaves into the first compartment of the microwave chamber.

The present invention is also directed at a microwave oven wherein the mounting means releasably mounts the tube within the microwave chamber and the microwave transparent tube is interchangeable with other microwave transparent tubes having different dimensions. Preferably, the mounting means clasps the tubular member at a portion near the first end thereof to facilitate the removal and replacement of the tube.

Preferably, the microwave chamber is supported on a housing and the support means for the tubular member comprises a drum rotatably mounted onto the housing. The drum is dimensioned and configured to retain and support the portion of the tubular member adjacent the first end, the drum also forming the second compartment of the microwave chamber. The oven is also provided with a mechanism for rotating the drum.

Preferably the drum is electrically isolated from the first compartment. Additionally, the drum may be provided with brackets removably mounted within the drum, the brackets dimensioned and configured to hold the tubular member within the drum. The brackets may be replaced with brackets having different dimensions to facilitate the insertion of microwave transparent tubes of different dimensions.

Preferably, the microwave transparent tube is completely contained within the microwave chamber. Finally, the oven may be provided with a means for selectively positioning the microwave transparent tube at an angle from the horizontal.

The invention is also directed at a microwave oven including a means for minimizing the leakage of microwaves from the oven, comprising an annular member having a cavity, said cavity dimensioned to receive microwaves leaking from the drum and destroying them by the process of destructive interference.

BRIEF DESCRIPTION OF THE DIAGRAMS

Further features and advantages of the method and device embodying the present invention will now be described and made clearer from the ensuing description, reference being had to the accompanying drawings, in which.

DETAILED DESCRIPTION OF THE PREFERRED EMBODIMENT

Figure 1:
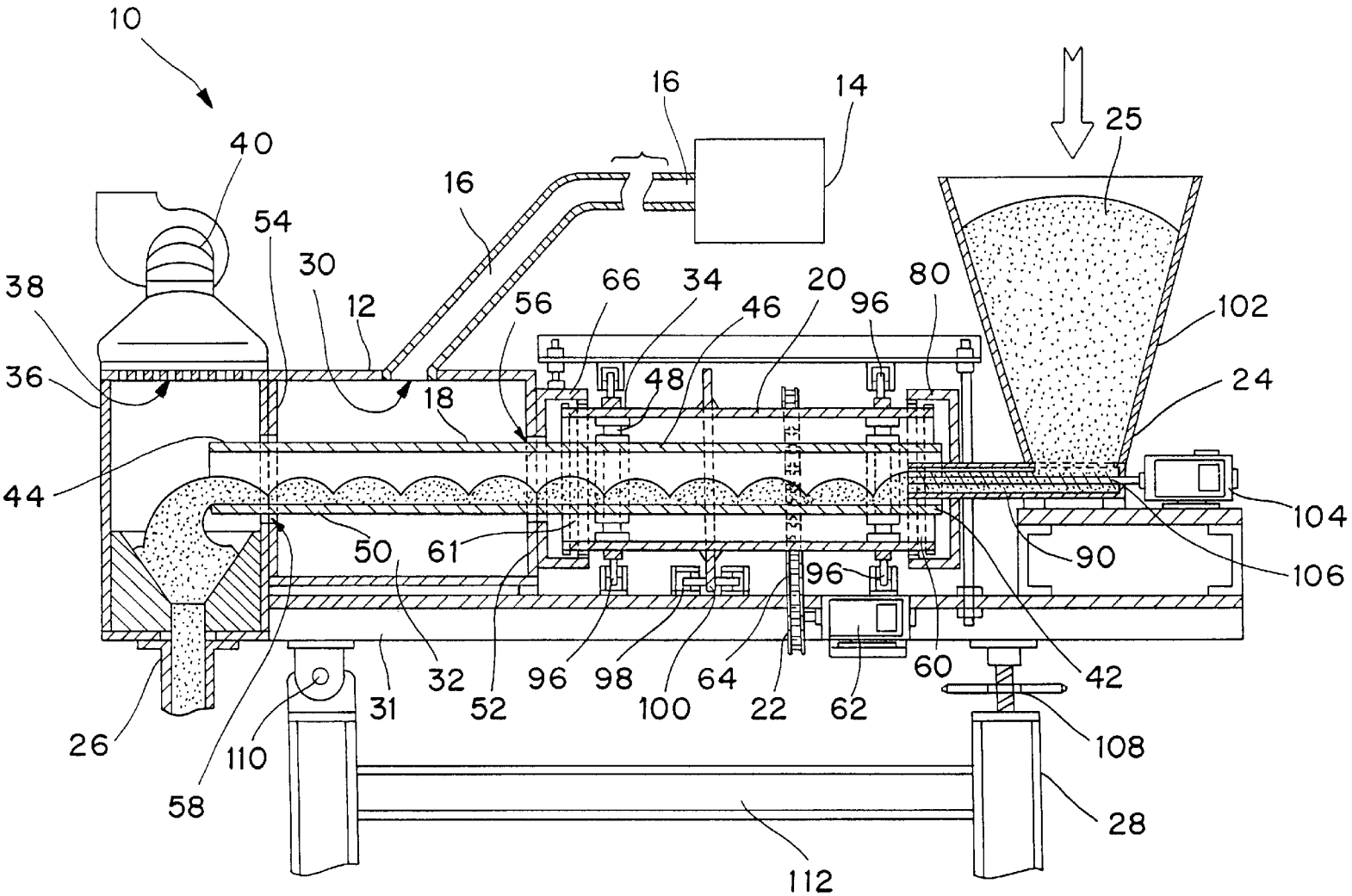
FIG. 1 is a side view taken in long section of the preferred embodiment of the invention showing material being heated.

Referring firstly to FIG. 1 a microwave furnace, shown generally as item 10, constructed in accordance with the present invention comprises a main microwave reflective chamber 12 coupled to a microwave generator 14 via microwave reflective waveguide conduit 16. A reactor tube 18 is mounted within main chamber 12 via mounting apparatus shown generally as 20. Mounting apparatus 20 comprises drum 34 and brackets 48 and is provided with rotating means shown generally as 22 for rotating reactor tube 18. Furnace 10 is also provided with a feeding mechanism shown generally as item 24, for inserting microwave absorptive material 25 into the reactor tube 18. Main chamber 12 is provided with a discharge 26, for discharging heated material. Finally, the main chamber 12 and feeding mechanism 24 are preferably mounted to a tiltable housing or rack, shown generally as item 28.

Main chamber 12 is made of a microwave reflective material such as steel or aluminum, and is provided with opening 30 dimensioned to receive waveguide conduit 16. Microwaves generated by microwave generator 14 travel down conduit 16 and out opening 30 into main chamber 12. Since the walls of chamber 12 are made of a microwave reflective material, most of the microwave energy is contained in the chamber until absorbed by material 25. Reactor tube 18 is made of a microwave transparent material permitting material 25 to absorb the microwaves.

Main chamber 12 is preferably compartmentalized into a microwave applicator compartment (first compartment) 32 and a rotatable drum compartment (second compartment) 34. Microwave applicator compartment 32 is rigidly mounted to frame 31 and rotatable drum compartment 34 is rotatably mounted to frame 31. Microwave applicator compartment directly receives the microwave energy from conduit 16 and, therefore, has the highest concentration of microwave energy. Rotatable drum compartment 34 does receive some microwave energy as it is reflected from the walls of applicator compartment 32. Microwave applicator compartment 32 is also provided with a discharge compartment 36, which in turn has discharge opening 26 and exhaust port 38. Exhaust fan 40, mounted to discharge compartment 36 above exhaust port 38, facilitates the removal of exhaust gases generated by the heating of material 25.

As mentioned above, reactor tube 18 is a hollow tubular member made of a microwave transparent material and is provided with an open first end 42 and an open second end 44. For high temperature applications reactor tube 18 is preferably made of quartz, mulite, or some other high temperature microwave transparent material. Teflon (Trade Mark) reactor tubes may be used for low temperature applications. For general purpose applications where temperatures are not to exceed 1000 degrees Centigrade, quartz reactor tubes can be used. Reactor tube 18 can be made from other temperature resistant microwave transparent materials.

Reactor tube 18 is preferably completely contained within microwave reflective compartment 12 to prevent leakage of microwave energy. To facilitate the complete enclosure of reactor tube 18, portion 46 of reactor tube 18 adjacent first end 42 is mounted within rotatable drum 34. Brackets 48 are provided to physically mount portion 46 of reactor tube 18 to the inside of drum 34. As mentioned earlier, mounting apparatus 20 comprises drum 34 and brackets 48. Preferably, brackets 48 are annular shaped members having an outside diameter equal to the inside diameter of drum 34 and an inside diameter equal to the outside diameter of reactor tube 18. If brackets 48 are made from a microwave reflective material, then they serve the additional function of decreasing the amount of microwave energy traveling towards first end 42 or reactor tube 18.

Reactor tube 18 is preferably supported within chamber 12 in a cantilever arrangement such that portion 50 of reactor tube 18 adjacent second end 44, is not supported. Portion 50 of reactor tube 18 is mostly contained within microwave applicator compartment 32. Since microwave applicator compartment 32 receives the highest intensities of microwave energy, any support structures located within the applicator compartment would partially shield portion 50 of reactor tube 18 and thereby reduce the heating efficiency of the reactor tube. Furthermore, having all of the support elements for reactor tube 18 localized in drum 34 greatly simplifies the removal and installation of different reactor tubes.

Microwave applicator compartment 32 preferably comprises a metal box having front wall 52 and back wall 54. Apertures 56 and 58, located on front wall 52 and back wall 54, respectively, are dimensioned to receive reactor tube 18. Front wall 52 reduces the flow of microwave energy into drum 34 while back wall 54 reduces the flow of microwave energy into discharge compartment 36.

Figure 2:
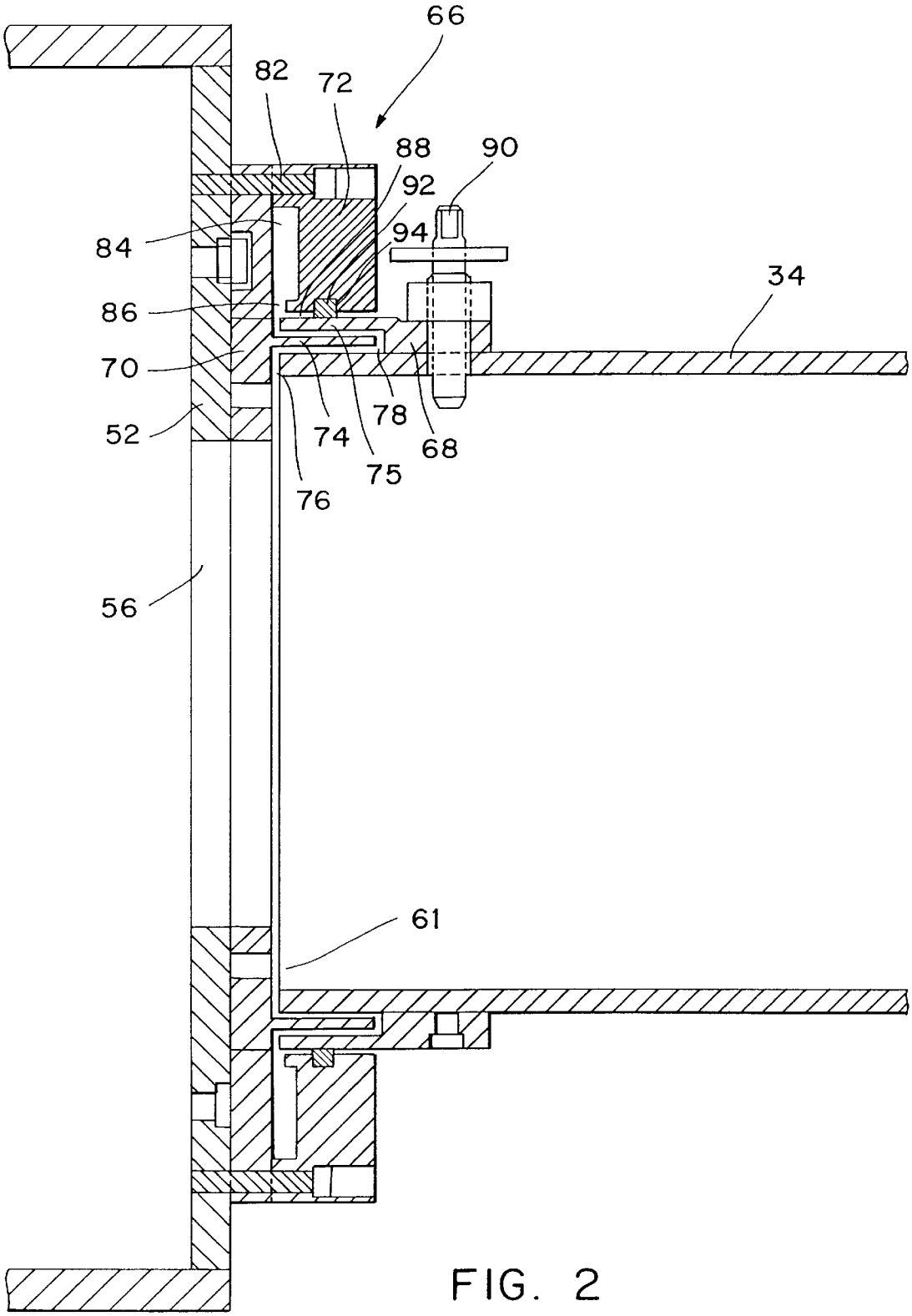
FIG. 2 is a sectional view of a portion of the preferred embodiment showing the choke portion of the invention.

Drum compartment 34 preferably comprises a hollow cylindrical metal drum having front opening 60 and rear opening 61. As mentioned above, reactor tube 18 is mounted within drum 34 via brackets 48. Brackets 48 are in turn removably mounted to drum 34 by means of removable nuts (not shown). Drum 34 is coupled to drum rotation motor 62 via chain 64. When drum rotation motor 62 is turned on, chain 64 causes drum 34 to rotate on its axis. Rotation of drum 34 causes reactor tube 18 to rotate on its axis in turn. Drum compartment 34 is electrically isolated from microwave applicator compartment 32 to prevent arching between the compartments. At no point does drum 34 contact microwave applicator compartment 32. To maintain the electrical isolation of drum 34, motor 62 is electrically isolated from frame To lessen the leakage of microwave energy at the intersection between drum compartment 34 and microwave applicator compartment 32, choke 66 is mounted to front wall 52 of microwave applicator compartment 32. As best seen in FIG. 2, choke 66 is positioned on front wall 52 of microwave applicator compartment 32. Choke 66 comprises annular members 68, 70 and 72. Annular member 68 is mounted to an end of drum 34 via removable connecting bolts 90. Annular members 70 and 72 are mounted to front wall 52 by bolt 82 at a position on front wall 52 adjacent to the end of drum 34. To prevent arching, drum 34 is separated from annular member 70 by space 76. To minimize the leakage of microwaves from the furnace, space 76 should be as narrow as possible, but at no point should drum 34 ever touch or make electrical contact with annular member 70.

Annular member 68 is provided with extended lip 75, which is seperated from drum 34 by space 78. Annular members 70 and 72 are mounted to front wall 52 via removable connecting bolts 82. Annular member 70 is provided with an extended lip 74 which is dimensioned to fit within space 78 in a "tongue in groove" fashion without making contact with annular member 68. The length of lip 75 of annular member 68 and the length of lip 74 of annular member 70 is approximately equal to one quarter of the wavelength of the microwaves used by the furnace. Annular member 72 is provided with recess which, when mounted to annular member 70, forms space 84. Opening 86, created between annular members 70 and 72, open into space 84. Annular member 72 is separated from annular member 68 by space 88. Opening 86 is dimensioned to have a greater diameter than space 88. Space 84 is dimensioned to have a length approximately equal to one quarter of the wavelength of the microwaves used by the furnace. Annular member 72 is provided with recess 88 which is dimensioned to receive gasket 94. Gasket 94 is made of an electrically insulative material which absorbs microwaves.

Referring back to FIG. 1, choke 80 is mounted to frame 31 at a position directly in front of opening 60 and between the drum and feeding mechanism 24 to lessen the leakage of microwave energy from front opening 60 of drum 34. Choke 80 is nearly identical in construction to choke 66, differing only in the dimension of its component members.

Drum 34 is rotatably mounted onto frame 31. Rollers 96 support drum 34 onto frame 31 while allowing the drum to rotate freely. Rollers 96 also prevent drum 34 from moving backwards or forwards during operation. Rollers 98 and plate 100 prevent drum 34 from tilting at an angle relative to frame 31. To maintain the electrical isolation of drum 34, rollers 96 and 98 are insulated.

Feeding mechanism 24 comprises hopper 102, auger motor 104, feeder tube 90 and auger 106. Material 25 placed in hopper 102 is fed by gravity into feeder tube 90. Auger motor 104 turns auger 106 and thereby drives material 25 through feeder tube 90. Feeder tube 90 extends through choke 80 and into open first 42 of reactor tube 18. Feeder tube 90 is electrically isolated from drum 34 to prevent any arching. Choke 80 prevents microwaves from leaking between feeder tube 90 and drum 34.

Frame 31 can be set at an angle from the horizontal by engaging jack 108 such that fame 31 pivots at point 10 relative to supporting sub-frame 112. Jack 108 is preferably adjustable so that any suitable angle can be selected. When frame 31 is at an angle of for example 10 degrees from the horizontal, material 25 moves quite smoothly through reactor tube 18.

To operate the device, the elevation of frame 31 is selected and then the material is loaded into hopper 102. Motors 62 and 104, fan 40 and microwave generator 14 are then turned on. Feeding mechanism forces material 25 through feeder tube 90 and into first end 42 of reactor tube 18. The force of gravity, assisted by the rotation of reactor tube 18, drives material 25 through reactor tube 18. Eventually, material 25 reaches portion 50 of reactor tube 18 where it absorbs a majority of the microwave energy. The heated material is then passed to discharge compartment 36 and out discharge opening 26. Exhaust fan 40 draws air from inside chamber 12 and reactor tube 18 ensuring that no gases emitted by the heating material leak out through the device.

Some microwaves passing through opening 56 of front wall 52 may leak through the space separating drum 34 from first compartment 32 and the space separating drum 34 from feeding tube 90. Chokes 66 and 80 prevent the leakage of microwaves out of oven 10 by destroying any leaking microwaves. Any microwaves leaking between drum 34 and first compartment 32 shall pass opening 76 into space 78. Since space 78 is approximately one quarter of the wavelength of the microwaves, destructive interference occurs and leakage past space 78 is minimized. A great majority of microwaves passing through space 78 will pass through opening 86 rather than opening 88 since opening 86 has a greater diameter. Once past opening 86, the microwaves enter space 84 where they experience destructive interference. Any microwaves which do pass through opening 88 are absorbed by gasket 94. As mentioned above, spaces 84 and 78 are dimensioned to be approximately equal to one quarter of the wavelength of the microwaves generated by the microwave generator. Other dimensions, such as one half, may also be effective in promoting the destructive interference of microwaves as they enter spaces 84 and 78.

The invention having been so described, certain modifications and adaptations will be obvious to those skilled in the art. The invention includes all such modifications and adaptations which follow in the scope of the appended claims.

We claim:

1. A microwave furnace for heating materials comprising a) a microwave chamber made of microwave reflective material for retaining microwaves and including a applicator compartment that has a discharge opening for discharging the heated material;

b) an elongated tubular member having an axis and a first and second open end, the tubular member being made of a microwave transparent material, at least a portion of the tubular member being retained within the applicator compartment;

c) a feeding mechanism for feeding the material to be heated into the first end of the tubular member;

d) a mount for supporting the tubular member in a microwaving position within the applicator compartment, the mount adapted to rotate the tubular member along its axis, the mount positioning the tubular member such that the second end of the tubular member is substantially adjacent the discharge opening of the microwave chamber, and e) a microwave generator for generating microwaves and guiding them into the applicator compartment;

wherein the tubular member and the applicator compartment are configured such that the applicator compartment permits the tubular member to be freely extracted therefrom.

2. A microwave furnace as defined in claim 1 wherein the microwave chamber comprises a second compartment and a dividing wall separating the applicator and second compartments, wherein in the microwaving position the second end is disposed in the applicator compartment with the discharge opening also located in the applicator compartment distanced from the second compartment, and the portion of the tubular member extends through the applicator compartment.

3. A microwave furnace as defined in claim 2 wherein the microwave generator guides the microwaves into the applicator compartment of the microwave chamber.

4. A microwave furnace as defined in claim 1 wherein the mounting means clasps the tubular member only at a portion near the first end thereof.

5. A microwave furnace as defined in claim 1 further comprising an adjustable support associated with the tubular member for selectively tilting the tubular member at an adjustable angle from the horizontal.

6. A microwave furnace as defined in claim 1 wherein the tubular member is completely contained within the applicator compartment and the drum in the microwaving position, wherein the drum is made of microwave reflective material.

7. A microwave furnace for heating materials comprising:

a) a microwave chamber made of microwave reflective material for retaining microwaves and including an applicator compartment that has a discharge opening for discharging the heated material;

b) an elongated tubular member having an axis and a first and second open end, the tubular member being made of a microwave transparent material, at least a portion of the tubular member being retained within the applicator compartment;

c) a feeding mechanism for feeding the material to be heated into the first end of the tubular member;

d) a housing supporting the applicator compartment;

e) a drum rotator;

f) a mount for supporting the tubular member in a microwaving position within the applicator compartment, wherein the mount comprises a drum rotatably mounted onto the housing, fixed to the tubular member, and dimensioned and configured to retain and support the tubular member adjacent the first end, the drum also forming a second compartment of the microwave chamber, the drum being rotatable by the drum rotator, and positioning the tubular member such that the second end of the tubular member is substantially adjacent the discharge opening of the compartment; and g) a microwave generator for generating microwaves and guiding them into the microwave chamber.

8. A microwave furnace as defined in claim 7 wherein the drum is electrically isolated from the first compartment.

9. A microwave furnace as defined in claim 8 further comprising brackets removably mounted within the drum, the brackets dimensioned and configured to hold the tubular member within the drum.

10. A microwave furnace as defined in claim 9 wherein the tubular member is interchangeable with other tubular members of different diameters.

11. A microwave furnace as defined in claim 7 further comprising a means for preventing the leakage of microwaves between the drum and the first compartment.

12. A microwave furnace as defined in claim 11 wherein the means for preventing leakage of microwaves is configured for minimizing the leakage of microwaves by destructive interference.

13. A microwave furnace as defined in claim 12 wherein the means for preventing leakage of microwaves comprises a first and second member, the first member having a groove and the second member having a tongue dimensioned to fit within the groove, the length of the groove and the length of the tongue being approximately one quarter the wavelength of microwaves generated by the microwave generator, one of said members being mounted to the drum, and the other said member being mounted to the applicator compartment.

14. A microwave furnace as defined in claim 12 wherein the means for preventing leakage of microwaves comprises an annular member mounted adjacent to a junction between the drum and the applicator compartment, said annular member having a cavity with a diameter approximately equal to one quarter of the wavelength of the microwaves generated by the microwave generator.

15. A microwave furnace as defined in claims 13 or 14 wherein the means for preventing leakage of microwaves further comprises an annular seal mounted adjacent a junction between the drum and the applicator compartment, said annular seal formed from a microwave absorptive material.

16. A microwave furnace for heating material, comprising:

a) a microwave applicator compartment having reflective material configured for retaining microwaves therein;

b) an elongated tubular member being transparent to microwaves and having a first portion with a first open end and a second portion with a second open end;

c) a feeding mechanism for feeding the material into the first end of the tubular member;

d) a mount located outside microwave applicator compartment and configured for rotatably supporting the first portion of the tubular member in a microwaving position with respect to the microwave applicator compartment such that the first portion and first end are disposed outside the microwave applicator compartment and the second portion and second end are disposed inside the microwave applicator compartment, wherein the second portion is cantilevered freely from the mount; and e) a microwave generator configured for generating microwaves and guiding them into the microwave applicator compartment.

17. The microwave furnace of claim 16, wherein:

(a) the microwave applicator compartment has a front wall defining a front aperture;

(b) the tubular portion is received through the front aperture when the tubular member is in the microwaving position; and (c) the second portion is insertable and extractable through the front aperture.

18. The microwave furnace of claim 16, wherein the tubular member and the microwave compartment are configured for such that the microwave compartment permits the tubular member to be freely extracted therefrom.

19. The microwave furnace of claim 16, wherein the tubular member and the microwave applicator compartment are positioned in the microwaving position free from contact with each other.

* * * * *